United States Patent [19]

Buck

[11] Patent Number: 4,986,146

[45] Date of Patent: Jan. 22, 1991

[54] CAMMING MEMBER FOR POWER TONGS

[76] Inventor: David A. Buck, 118 Rue du Pain, Broussard, La. 70518

[21] Appl. No.: 493,009

[22] Filed: Mar. 13, 1990

Related U.S. Application Data

[63] Continuation-in-part of Ser. No. 329,933, Mar. 28, 1989, abandoned.

[51] Int. Cl.[5] ..... B25B 28/00

[52] U.S. Cl. ..... 81/57.18; 81/57.21

[58] Field of Search ..... 81/57.34, 57.33, 57.18, 81/57.15, 57.16, 57.2, 57.21

[56] References Cited

U.S. PATENT DOCUMENTS

| | | |
|---|---|---|
| Re. 31,699 | 10/1984 | Eckel . |
| 2,879,680 | 3/1959 | Beeman et al. . |
| 3,023,651 | 3/1962 | Wallace . |
| 3,086,413 | 4/1963 | Mason . |
| 3,140,624 | 7/1964 | George . |
| 3,180,186 | 4/1965 | Catland . |
| 3,261,241 | 7/1966 | Catland . |
| 3,371,562 | 3/1968 | Kelley . |
| 3,380,323 | 4/1968 | Campbell . |
| 3,507,174 | 4/1970 | Dickmann . |
| 3,518,903 | 7/1970 | Ham et al. . |
| 3,548,692 | 12/1970 | Dickmann . |
| 3,776,320 | 12/1973 | Brown . |
| 3,847,040 | 11/1974 | Bufkin . |
| 4,084,453 | 4/1978 | Eckel . |
| 4,290,304 | 9/1981 | Eckel . |
| 4,372,026 | 2/1983 | Mosing . |
| 4,402,239 | 9/1983 | Mooney . |
| 4,404,876 | 9/1983 | Eckel . |
| 4,576,254 | 3/1986 | Cox . |
| 4,649,777 | 3/1987 | Buck . |
| 4,709,599 | 12/1987 | Buck . |

FOREIGN PATENT DOCUMENTS

| | | |
|---|---|---|
| 1215967 | 12/1970 | United Kingdom . |
| 1348954 | 3/1974 | United Kingdom . |

*Primary Examiner*—D. S. Meislin

*Attorney, Agent, or Firm*—Robert C. Tucker; William David Kiesel

[57] ABSTRACT

A camming member for power tongs is provided, comprising a body including a central opening formed therein, the body being rotatable about a center point within the central opening, the body further including a slot for positioning a tubular member within the central opening, the body further including at least one cam surface adjacent to the central opening, the cam surface being formed such that, constant compressional force is applied to the tubular member by jaws urged inward by the cam surface. It is preferable that the body is ring-shaped and is provided with gear teeth radially extending from the outer periphery of the body.

8 Claims, 4 Drawing Sheets

CAMMING MEMBER FOR POWER TONGS

BACKGROUND OF THE INVENTION

Related Applications

This is a continuation-in-part application of application Ser. No. 07/329,933 filed Mar. 28, 1989, now abandoned specific mention being made herein to obtain the benefit of its earlier filing date.

Field of the Invention

This invention relates generally to devices known as "power tongs" which grip and rotate tubular members, such as drill pipe. More particularly, this invention relates to camming members contained within power tongs, which urge gripping jaws into contact with pipes.

Prior Art

Power tongs have been in existence for many years, and are generally employed in the oil and gas industry to grip and rotate tubular members, such as drill pipe. It is necessary to grip drill pipe with high compressive forces while applying a high degree of torque in order to break apart or tighten threaded pipe connections. In most cases, power tong designs employ a cam mechanism for converting a portion of the torque into a gripping (compressive) force normal to the pipe. This conversion is often accomplished utilizing a power driven ring gear having an interior cam surface. A cam follower (roller) on a jaw member rides upon the cam surface. As the ring gear is rotated, the follower (and thus the jaw member) is urged into contact with the pipe. An example of such an arrangement can be seen in U.S. Pat. No. 4,404,876.

The amount of gripping force applied to the pipe is dependent upon the curvature of the cam surface at the point on the cam surface where the cam follower contacts the cam surface and urges the jaw member into contact with the pipe. Due to variance in pipe diameters (because of pipe wear, pipe scale, manufacturing error or other reasons), the cam follower may contact the cam surface at different points. A conventional power tong cam surface is constructed as an arc having its center spaced from the center of rotation of the tong (again, see U.S. Pat. No. 4,404,876). However, due to this construction, the rate at which the cam surface curves toward the center of the tool varies, causing the compressive force exerted on the pipe to also vary depending upon where the cam follower contacts the cam surface. Too much gripping force can result in the tong crushing the pipe. Too little force can cause the tong to slip. It is therefore desirable to attain a relatively constant optimum gripping force regardless of where the cam follower contacts on the cam surface.

SUMMARY OF THE INVENTION

Therefore, it is an object of this invention to provide a camming member for power tongs, the camming member having a cam surface which causes a relatively constant compressive, or gripping, force to be exerted on a tubular member for a given torque applied to the camming member.

It is another object of this invention to provide such a camming member for power tongs which is easily adaptable to existing power tong designs.

Accordingly, a camming member for power tongs is provided comprising a body including a central opening formed therein, the body being rotatable about a center point within the central opening, the body further including a slot for positioning a tubular member within the central opening, the body further including at least one cam surface adjacent to the central opening, the cam surface being formed such that, the distance between the center point and the cam surface changes at a constant rate relative to an angular change in the position of the camming member. It is preferable that the body is ring-shaped and is provided with gear teeth radially extending from the outer periphery of the body.

DETAILED DESCRIPTION OF PREFERRED EMBODIMENTS OF THE INVENTION

Figure 1:
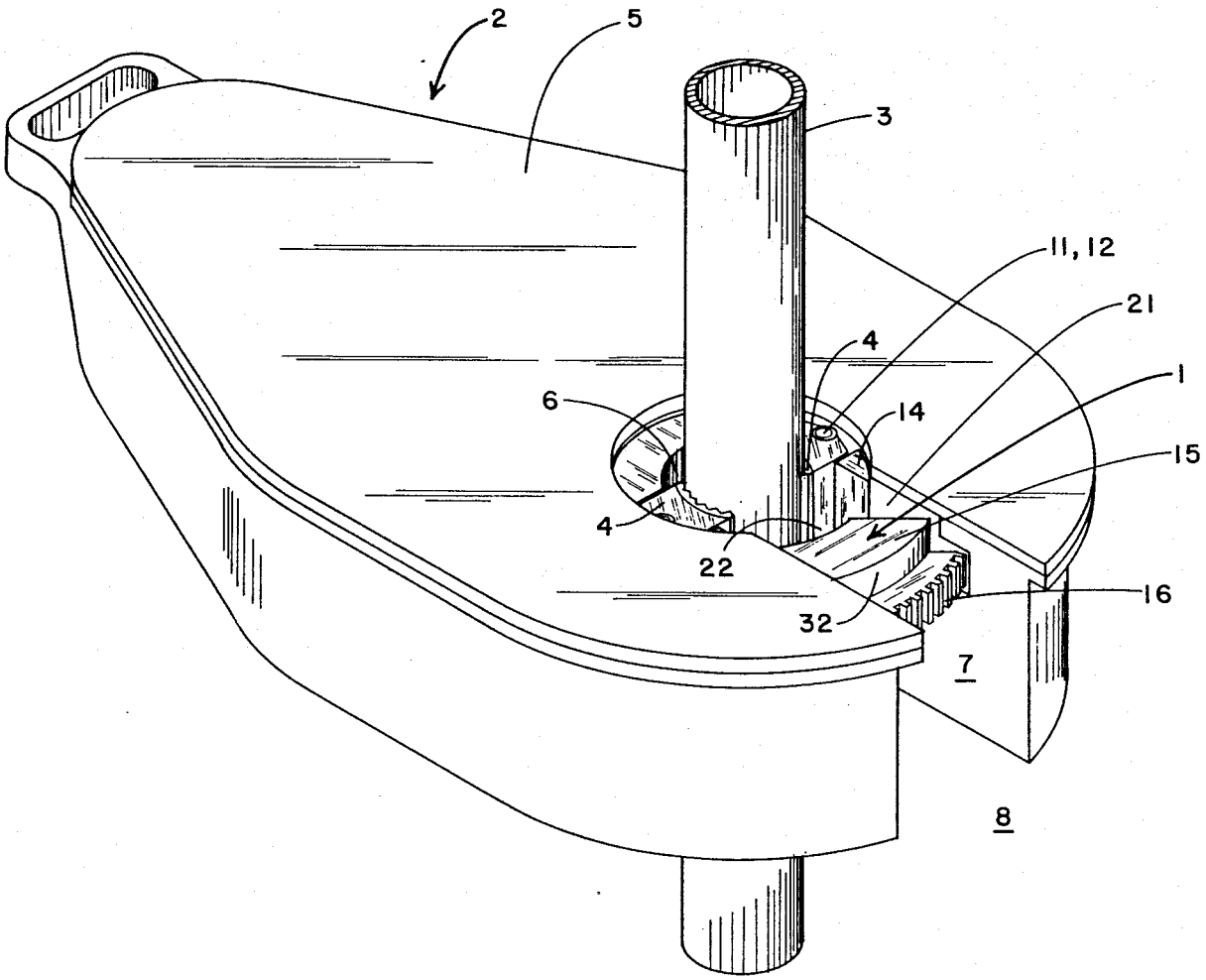
FIG. 1 is a perspective view of a power tong in place around a pipe.
Figure 2:
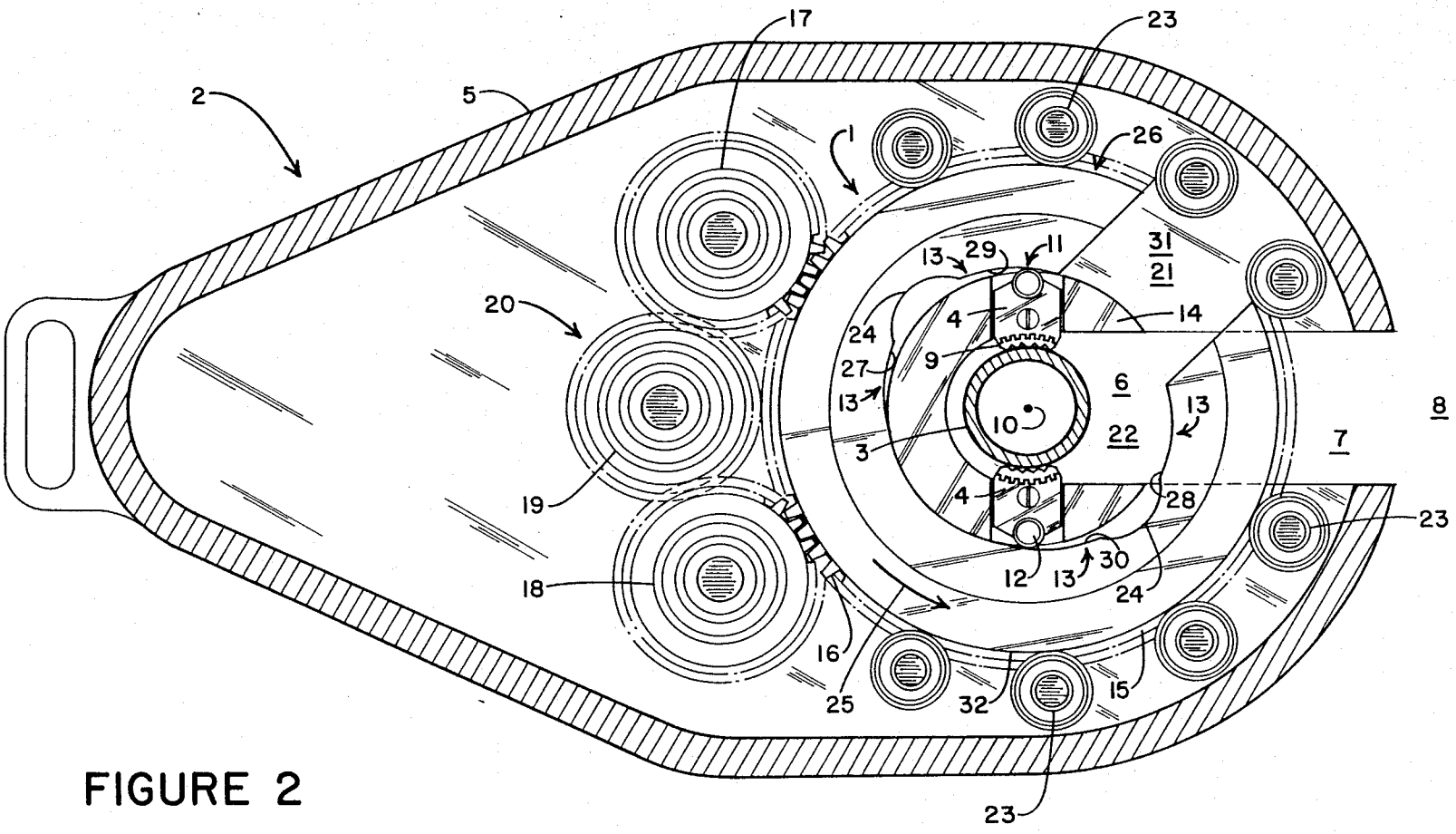
FIG. 2 is a cutaway top view of a power tong incorporating a preferred embodiment of the camming member of this invention.
Figure 3:
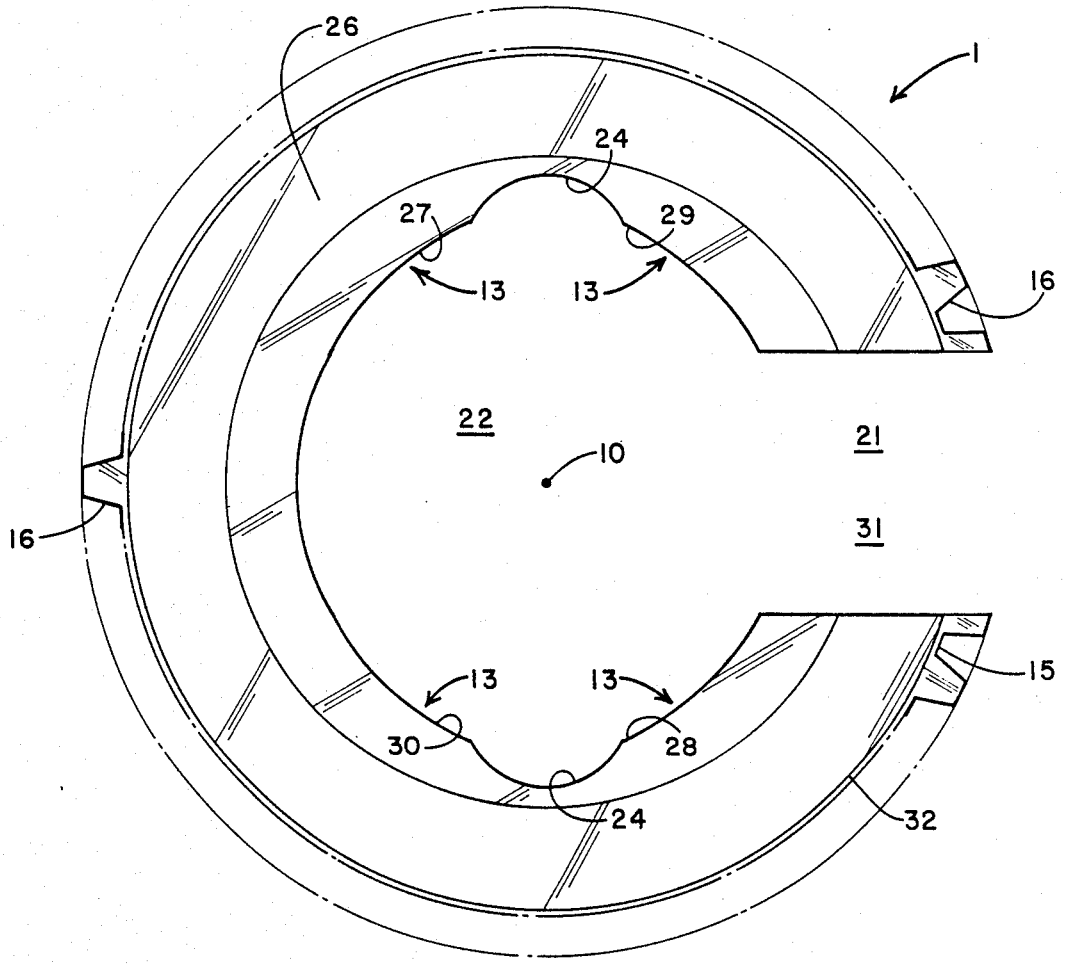
FIG. 3 is a top view of a preferred embodiment of the camming member of this invention.

As can be seen in the Figures, a camming member 1 is contained in a power tong 2, which engages a tubular member 3, such as a pipe, via jaw members 4 or other means known in the art. A typical power tong 2, comprises an enclosure structure 5, having a center opening 6 of sufficient size for a pipe 3 to pass therethrough, as shown. A slot 7 communicates between the exterior 8 of enclosure structure 5 and center opening 6, such that the power tong 2 can be placed around pipe 3 by passing pipe 3 through slot 7. Usually, a plurality of jaw members 4 are disposed within enclosure structure 5 such that jaw members 4 protrude into center opening 6. Each jaw member 4 preferably includes a gripping surface 9 facing toward a center point 10 within center opening 6. Various gripping surfaces 9 are known in the art, an example of which can be seen in U.S. Pat. No. 4,576,067 to David Buck. When pipe 3 is in place within the power tong 2, as shown in FIGS. 1 and 2, it is preferable that center point 10 be the center of rotation for the pipe 3. Thus, jaw members 4 are engageable with pipe 3 so as to rotate pipe 3 about center point 10. At least one jaw member 4 is provided with a cam follower 11, such as roller 12 or other means known in the art. Follower 11 rides on a cam surface 13 on camming member 1. As camming member 1 moves relative to follower 11, jaw member 4 is urged into contact with pipe 3 or releases from contact with pipe 3, depending upon the direction of movement. Usually, camming member 1 rotates while jaw members are maintained in a non-rotative position by jaw carrier 14 and a braking system (not shown). Jaw carrier 14 allows jaw members 4 to slide toward and away from center point 10.

Camming member 1 preferably comprises a ring gear 15, which is disposed within enclosure structure 5. However, camming member 1 can generally comprise a body 26 which incorporates a central opening 22, at least one cam surface 13 and is rotatable about center point 10. Cam surfaces 13 are disposed on either side of a pair of neutral surfaces 24. Cam surfaces 27 and 28 cause jaw members 4 to engage pipe 3 for clockwise rotation, and cam surfaces 29 and 30 cause pipe 3 to be engaged for counterclockwise rotation. Neutral surfaces 24 provide a position for cam followers 11 when jaw members are retracted from pipe 3. Camming member 1 is driven by a means 20, engageable with camming member 1, for rotating camming member 1. Preferably ring gear 15 is provided with teeth 16, which mesh with rotary idler gears 17 and 18, which are in turn driven by pinion idler gear 19. Pinion idler gear 19 is driven by a hydraulic drive (not shown) or other means known in the art. Gears 17, 18, 19 and hydraulic drive (not shown) are an example of means 20. Camming member 1 is substantially concentric with center opening 6, as shown, and is rotatable about center point 10. Camming member 1 is further provided with a means 31 for positioning pipe 3 in central opening 22, such as a slot 21, which is alignable with slot 7 such that pipe 3 can be received in central opening 22 of camming member 1. Rollers 23 are disposed within enclosure structure 5, and bear against and contain a smooth surface 32 on ring gear 15, providing resistance to spreading when jaw members 4 are engaged with pipe 3. Ring gear 15 may take any of several forms known in the art, provided cam surfaces 13 are constructed in accordance with the invention. An example of overall ring gear construction can be seen in U.S. Pat. No. 3,180,186, FIG. 8 at 40.

In operation, as ring gear 15 is rotated either clockwise or counterclockwise, rollers 12 climb from neutral surfaces 24 onto cam surfaces 13, which are shaped such that rollers 12 are urged toward center point 10. When jaw members 4 contact pipe 3, torque applied to camming member 1 is converted into both rotative and compressive (toward center point 10) forces, which are applied to pipe 3. As stated above, the construction of prior art cam surfaces results in a substantially different compressive force for each location of cam follower 11 on cam surface 13. Thus, on prior art power tongs, as pipe diameters vary, the point at which the cam follower contacts the cam surface varies, the angle at which cam follower contacts the cam surface varies, and the compressive force applied to the pipe varies. The cam surface 1 of the instant invention results in a relatively constant compressive force being applied to pipe 3, due to distance from the centerpoint to the cam surface (radius) multiplied by the tangent of the angle of cam surface 13 at the point of contact being a constant. The value of the constant depends upon the torque applied to camming member 1, the compressive force exerted by jaw members 4 on pipe 3 and the number of jaw members 4 which divide the load.

Figure 4:
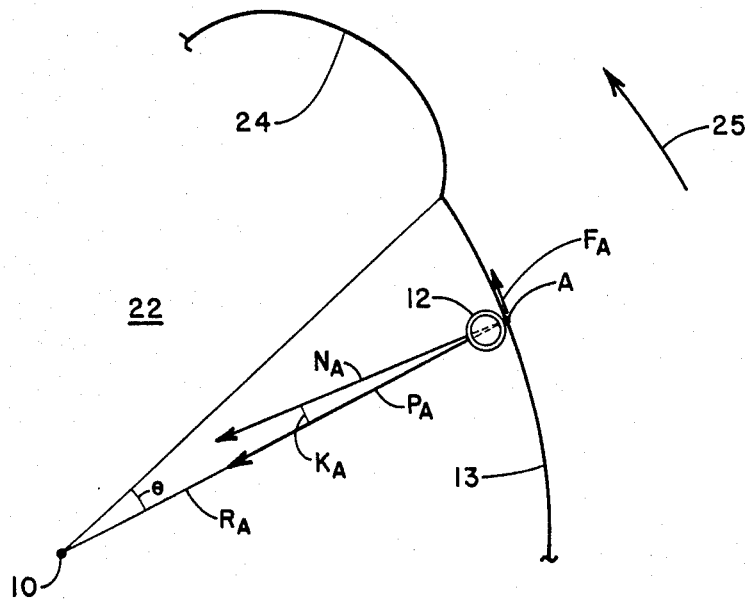
FIG. 4 is a graphic depiction of an embodiment of the cam surface of this invention.

FIG. 4 shows a magnified graphic depiction of a portion of cam surface 13. Roller 12 is shown in contact with cam surface 13 at position A. $R_A$ is the radius or distance between centerpoint 10 and cam surface 13 at position A. $N_A$ is the force normal to cam surface 13 at position A and can be broken down into a compressive component $P_A$ along radius $R_A$ and a torque counteracting component $F_A$ which is tangential to roller 12 at position A. Angle $K_A$ is the angle of the cam surface at position A.

The torque T applied to camming member 1 at position A is equal to $F_A$ multiplied by $R_A$ multiplied by n, the number of jaw members 4. Thus, $$T = nF_AR_A$$

Since, $$\frac{F_A}{P_A} = \tan K_A$$

Then,

-continued $$\frac{T}{nP_A} = R_A \tan K_A$$

The torque and number of jaw members 4 are constant and it is desired to maintain the compressive force $P_A$ constant. Consequently, $R_A \tan K_A$ is a constant.

The change in radius for an angular change $\theta$ in rotation of camming member 1 can be calculated to be:

$$\frac{dR}{d\theta} = -R \tan K = \text{constant}$$

Given the above equations and constants, a starting cam surface angle K may be selected and a curve generated which will have the property of causing a substantially uniform compressive force to be exerted on pipe 3 during operation of power tong 2. Of course, neutral surfaces 24 are not intended to be manufactured according to the specifications of cam surfaces 13. In a preferred embodiment, the curve of cam surface 13 is cut on a numerical controlled mill. Polar coordinates may be converted to Cartesian coordinates for any position A by applying the following formulas:

$$X_A = R_A \cos \theta_A$$

$$Y_A = R_A \sin \theta_A.$$

As can be seen, a camming member 1 for power tongs is provided which results in the application of a substantially constant compressive force to pipe 3. The camming member 1 in the form of ring gear 15 can easily replace conventional ring gears in existing power tongs. Other embodiments of the invention will occur to those skilled in the art, and are intended to be included within the scope and spirit of the following claims.

I claim:

1. A camming member for power tongs, comprising a body including a central opening formed therein, said body being rotatable about a center point within said central opening, said body further including a means for positioning a tubular member within said central opening, said body further including at least one cam surface being adjacent to said central opening, said cam surface being formed such that, a distance between said centerpoint and said cam surface changes at a constant rate relative to angular change in the position of said camming member.

2. A camming member for power tongs according to claim 1, wherein said body is shaped in the form of a ring and is provided with a plurality of said cam surfaces, with one said cam surface spaced on either side of a neutral surface, said neutral surface being at a greater distance from said center point than any point on said cam surface.

3. A camming member for power tongs according to claim 2, wherein said body is provided with gear teeth radially extending from the outer periphery of said body.

4. A power tong, comprising:

a. an enclosure structure, having a center opening of sufficient size for a tubular member to pass through and a slot communicating between the exterior of said enclosure structure and said center opening;

b. a plurality of jaw members disposed within said enclosure such that said jaw members protrude into said center opening, each said jaw member having a gripping surface facing toward a center point within said center opening so as to be engageable with said tubular member, at least one said jaw member further including a cam follower;

c. a camming member, including a central opening formed therein, said camming member being disposed within said enclosure such that said central opening of said camming member is substantially concentric with said center opening of said structure, and said camming member is rotatable about said center point, said camming member further including a slot alignable with said slot of said enclosure, said camming member further including at least one cam surface adjacent to said central opening, said cam surface being formed such that, a distance between said centerpoint and said cam surface changes at a constant rate relative to angular change in the position of said camming member, said camming surface being engageable with said cam follower such that, as said camming member rotates in a desired direction, said follower is urged toward said center point; and d. a means, engageable with said camming member, for rotating said camming member.

5. A power tong according to claim 4, wherein said camming member is shaped in the form of a ring and is provided a plurality of said cam surfaces, with one said cam surface spaced on either side of a neutral surface, said neutral surface being at a greater distance from said center point than any point on said cam surfaces.

6. A power tong according to claim 5, wherein said camming member is provided with gear teeth radially extending from the outer periphery of said body.

7. A camming member for power tongs including a body having a central opening formed therein, said body being rotatable about a centerpoint within said central opening, said body further having means for positioning a tubular member within said central opening, wherein the improvement comprises a cam surface facing said central opening and curving inward toward said centerpoint, said cam surface being formed such that, at any position on said cam surface, the tangent of the cam surface angle multiplied by the distance between said centerpoint and said position on said cam surface is constant.

8. A camming member as in claim 7 wherein a distance between said centerpoint and said cam surface changes at a constant rate relative to angular change in the position of said camming member.

* * * * *